United States Patent [19]

Krumpelt

[11] 4,115,218

[45] Sep. 19, 1978

[54] METHOD OF ELECTROLYZING BRINE

[75] Inventor: Michael Krumpelt, Riverview, Mich.

[73] Assignee: BASF Wyandotte Corporation, Wyandotte, Mich.

[21] Appl. No.: 735,115

[22] Filed: Oct. 22, 1976

[51] Int. Cl.[2] ..... C25B 1/16; C25B 1/26; C25B 13/08; C25B 15/08

[52] U.S. Cl. ..... 204/98; 204/128

[58] Field of Search ..... 204/98, 128, 296

[56] References Cited

U.S. PATENT DOCUMENTS

| | | | |
|---|---|---|---|
| 3,341,441 | 9/1967 | Giuffrida et al. | 204/180 P |
| 3,897,320 | 8/1977 | Cook | 204/98 |
| 3,988,223 | 10/1976 | Hirozawa | 204/98 |
| 4,040,919 | 8/1977 | Eng | 204/98 |

*Primary Examiner*—R. L. Andrews
*Attorney, Agent, or Firm*—John W. Linkhauer; Bernhard R. Swick; Robert E. Dunn

[57] ABSTRACT

A practical method of electrolyzing sodium chloride brine on a commercial scale, obtaining in good yield a caustic product exceptionally low in salt content, is provided. The process necessarily involves working with a brine of lower calcium-ion content than is ordinarily used, using dimensionally stable anodes, using, preferably but not necessarily, a heat-treated ion-exchange membrane as a separator within the cell, and periodically taking action to reduce the cell voltage, by reducing the current or interrupting it, alone or with a concomitant flushing of the catholyte portion of the cell.

8 Claims, No Drawings

METHOD OF ELECTROLYZING BRINE

BACKGROUND OF THE INVENTION

1. Field of the Invention

This invention relates to the electrolysis of sodium chloride brines, and in particular to a method in which brine is provided to the anolyte compartment of a bipolar electrolytic cell while water is fed to the catholyte compartment, the anolyte compartment being separated from the catholyte compartment by an ion-exchange membrane which is permeable to sodium ions but substantially impermeable to chlorine ions.

2. Description of the Prior Art

Prior to the present invention, the commercially used equipmemnt for the large-scale electrolysis of brine has been either a mercury cell or a diaphragm cell. Both the mercury cell and the diaphragm cell have particular drawbacks. Although the mercury process yields a caustic of low salt content, it gives considerable difficulty in respect to compliance with pollution-control laws and regulations. The diaphragm process inherently produces a caustic product which contains a proportion of salt, and while there are some purposes for which such a product may be used without difficulty, there are a number of other purposes which require a substantially salt-free product.

Various ion-exchange membrane materials have been available for over twenty years, it has long been apparent to those skilled in the electrolysis of brine that it would be desirable to have a process in which a permselective membrane is used in a cell to separate the anolyte compartment from the catholyte compartment, in place of the asbestos diaphragms customarily used in the diaphragm process. In laboratory tests, cells operating with permselective membranes as separators have been made and tested. There has not, however, been designed a commercially feasible process, because there are many difficulties which must be overcome before the idea of using a permselective membrane as a separator in a chlor-alkali cell can be brought to commercial reality. Some of the early membranes did not have adequate physical strength, and others did not have adequate inertness with respect to the brine and the caustic solutions with which the membrane was required to be in contact for a substantial service life. Still other materials, although satisfactory in regard to the requirements just mentioned, gave disappointing results in respect to the cell voltages required and the current efficiencies observed. Commercial cells for the electrolysis of brine deal with immense quantities of liquids and use immense amounts of electrical power, while producing products (chlorine and caustic) which are relatively inexpensive. A new process which must compete with the existing mercury and diaphragm processes must be relatively low in its consumption of electrical power. A reduction in cell voltage of 0.15 volt, or an increase in current efficiency of two percent, is certainly significant in terms of the costs of practicing the process. The costs are also significantly affected by the frequency with which it is necessary to interrupt the operation of the process. In general, interruptions any more frequent than about once a month are not tolerable. The art has been advanced by the development of dimensionally stable anodes, made of ruthenium- oxide- or platinum-coated titanium or the like, in place of the graphite anodes previously used.

One particular problem, in connection with the operation of membrane-type cells, has been that the cell voltage tends to rise with time, and it has been appreciated that this increase in cell voltage is associated with the precipitation of calcium hydroxide particles within the membrane. This implies that the control of the calcium content of the brine fed to the process is of considerable importance.

Those skilled in the art of operating diaphragm cells are familiar with the practice customarily employed to reduce the calcium content of raw brine to a satisfactorily low level, such as about ten parts per million of calcium. The raw brine is treated with sodium carbonate to precipitate calcium ions as calcium carbonate. The treated brine is freed of calcium carbonate by settling and/or filtration. Some fine particles of calcium carbonate survive this treatment, so that the treated or polished brine ordinarily contains, as mentioned above, about ten parts per million of calcium. The volumes of liquid dealt with are so immense, however, and the times of operation are so long that even this small proportion of calcium is sufficient to give difficulty. Those skilled in the art have not known, prior to the present invention, how this difficulty may be overcome, and a reliable, economical membrane-cell process thus practiced.

In general, there is good reason for those skilled in the art to look away from the improving of the quality of the brine and reducing or interrupting the supply of current to the cell as means to maintain a low cell voltage. Although other things being equal, a purer brine is obviously desirable, it has not been apparent to those skilled in the art that the expense of practicing a better calcium-removal method could be justified, and that the control of calcium, in a membrane electrolysis process, is as important as it is. There has been instead a tendency to try other membrane materials, in the hope of finding one that will work better and not make it necessary to change the existing brine-treatment practices.

SUMMARY OF THE INVENTION

A practical method for the large-scale electrolysis of sodium chloride brine, using a permselective membrane as a separator between the anolyte compartment and the catholyte compartment is provided. There is used a filter-press construction, using bipolar electrodes including dimensionally stable anodes and cathodes of steel mesh, which are preferably plated or coated with nickel. A heat-treated membrane, such as that described in copending application Ser. No. 619,606, filed Oct. 6, 1975, now abandoned, is preferably, but not necessarily, employed. Brine containing about 6 parts per million of calcium or lower, preferably about 1 part per million, is used in place of the (10 parts per million of calcium or higher) brine usually processed in accordance with the prior art. At suitable infrequent intervals, such as once per month, to solubilize the calcium trapped within the membrane, the applied current to the cell is greatly reduced, for example, to twenty percent or less of the normal current, or interrupted altogether for a suitable period of time, such as one minute to thirty minutes, and preferably, but not necessarily in all circumstances, the flow of water to the catholyte compartment is increased to a greater than normal value, such as five to twenty times the normal value, to flush the catholyte compartment. When such measures are taken, a practical electrolyte-cell process for the electrolysis of sodium chloride brines, using a permselective membrane as a separator, is obtained.

DESCRIPTION OF THE PREFERRED EMBODIMENTS

This invention makes available to the chemical industry the benefits of a commercial process for the electrolysis of sodium chloride brine, using permselective membranes as separators of the anolyte and catholyte compartments. A principal benefit is that a caustic is produced which does not contain sodium chloride. Another benefit is that, unlike with the diaphragm cells of the prior art, there is a more productive use of floor space, since with cells of a given height, substantially all of the cell height may be devoted to electrolysis, whereas with the diaphragm cells of the prior art, it was always necessary to have some considerable proportion of the cell height devoted to providing the necessary head to force the anolyte through the diaphragm into the catholyte compartment. In the practice of the present invention, there will at least preferably be used certain features which have themselves been a subject of invention but have not, by themselves and in combination with other things known, afforded a practical and economical membrane-using process for the electrolysis of sodium chloride brine. For example, there may be mentioned the dimensionally stable anodes of U.S. Pat. No. 3,682,498 and the like, the permselective membranes of the copending application Ser. No. 619,606, filed Oct. 6, 1975, now abandoned, and, in a preferred embodiment, the bipolar connectors of U.S. Pat. No. 3,788,966. The present invention particularly concerns the improvement which is obtained, in a process using the features mentioned above or their equivalents, when the brine processed is limited to a calcium content of six parts per million or less and, as a measure for periodically reducing the cell voltage, there is practiced (a) at least the reduction to a value twenty percent of normal or less the current through the cell, or the complete interruption of such current, for a period of time from approximately 5 to 30 minutes, alone or together with (b) a flushing of the catholyte compartment of the cell, by the use of a practice involving adding water to the catholyte compartment at a volumetric rate of approximately five to twenty times as normal. These steps, taken in conjunction with what is already known, yield a practical process.

Brine of suitably low calcium content may be prepared in any suitable manner which suggests itself to those skilled in the art. Satisfactory results may be obtained by using, for example, a flocculating agent such as polyacrylamide of molecular weight between one million and ten million or a copolymer of acrylamide and acrylic acid of about the same molecular weight, and then using a somewhat better filtering process. The exact details of how the desired low calcium content is to be obtained do not form a part of this invention. The making of a sodium chloride brine of low calcium content, about 5 parts per million or lower, is well within the skill of the art. Those skilled in the art know that the polyacrylamide or the like may be added to the reaction mixture at some suitable rate, such as 1 to 30 parts per million, or whatever the manufacturer recommends with respect to accelerating the precipitation of particles of inorganic nature. It is not difficult, moreover, to devise a filtration process more exacting than that customarily employed in accordance with the prior art, which uses filtration through a bed of sand. Still other methods for obtaining low-calcium brine may suggest themselves to persons of ordinary skill in the art, and any of them may be used, so long as the requisite low calcium content in the brine is achieved.

In accordance with the present invention, the other particular feature employed is a reduction or interruption, of the current applied to the cell. In the case of a reduction of current applied, it is a substantial reduction, to a level approximately twenty percent or less of that used when the cell is in ordinary operation, and more usually to about 5 percent or less. It is entirely satisfactory, moreover, to interrupt the flow of current entirely.

The length of time for which the current is reduced or interrupted, depends upon the circumstances, but it is usually in the range of 0.5 to 90 minutes, and most often in the range of 1 to 20 minutes. The objective is to cause the calcium which has become precipitated within the membrane to become resolubilized, and the length of time that it will take to accomplish this objective is dependent, among other things, upon the length of time that the cell has already been permitted to run and the calcium content of the brine which has been used in the cell. Different results occur. Sometimes, an interruption of as little as a half minute will bring about a reduction of the cell voltage from, for example, 4.1 volts to 3.57 volts, and sometimes an interruption of more than one hour will have little or no apparent effect. In the latter case, it is often found that the cell has been operating for some considerable time upon brine of relatively high calcium content, so that the interruption, long as it was, was not sufficient to cause substantial solubilization of all or nearly all of the calcium within the membrane. In the former case, in contrast, it is usual to find that the cell has been operated on brine of desirably low calcium content, and not for a period of time too great, so that a relatively brief period of current reduction or current interruption will suffice.

In general, the step of reducing or interrupting the current to solubilize the calcium deposited in the membrane and bring about a reduction in the cell voltage is not a step that is undertaken any more frequently than about once per month, and desirably somewhat less often than that, since any interruption of the electrolysis process tends to be costly. How frequently the step needs to be practiced depends upon the calcium content of the brine. With a brine containing 10 parts per million of calcium hardness or greater, such as the usual brines employed in commerical diaphragm processes, it would probably be necessary to interrupt the process twice or four times per month, or even more frequently than that, such as daily. On the other hand, it has been discovered that if the calcium content of the brine is kept down to six parts per million or less, and preferably at about one part per million, the need for the cell-voltage-reducing step occurs far less frequently. The present invention is useful so long as brine very low in calcium, such as 200 parts per billion or less, is not available at modest cost. It is, incidentally, the calcium in the brine which causes the problem, and not the magnesium; in a diaphragm process, both of these metals operate to give problems, but in a membrane-type electrolysis of sodium chloride brine, the results of our research indicate that the magnesium becomes precipitated as a gel on the surface of the separator membrane on the anolyte side, but such gell does not appear to have any substantial effect upon the current efficiency or the cell voltage, whereas the usual slight daily increase in cell voltage necessary to maintain a given level of current, such as 25 amperes for 18 square inches (116 square centimeters) of membrane and electrode area, can be correlated directly with the calcium content of the brine employed. There should be used a brine of calcium content low enough that the average daily increase in cell voltage does not amount to more than approximately 3 millivolts per day; in that way, there is observed over a period of 1 month an increase in cell voltage of approximately 0.1 volt, and this can be eliminated in accordance with the invention, by interruption or substantial reduction of the current through the cell for a relatively short period of time, such as 5 to 30 minutes.

Desirably, but not absolutely necessarily, there is also practiced in accordance with the present invention a catholyte flush. While the current is reduced or eliminated, as indicated above, there is at the same time practiced a substantial increase in the rate of flow of water into the catholyte compartment, to a level 5 to 20 times normal. This has the effect of favoring the removal of solubilized calcium. It is a helpful measure, but it is not one that, by itself, can solve the problem of removing precipitated calcium from the membrane. When a catholyte flush has been tried alone, without simultaneous reduction or interruption of current, no substantial improvement (lowering) of the cell voltage has been observed.

Relatively high cell voltage is not always caused by calcium in the membrane. The cell voltage is importantly influenced by the operating temperature; the cell voltage passes through a minimum when the operating temperature is in the vicinity of 90° C. When the operating temperature is lower than that, the cell voltages tend to be higher. Another important factor is the concentration of the caustic to be produced. In general, if it is permissible to operate the cell to produce a caustic of 5 Normal or 3 Normal concentration, the cell voltages will be substantially lower and the current efficiencies will be substantially better than if the cell must be operated to produce caustic having a normality of 10 or 13. Of course, a product of such dilute nature finds fewer uses than the more concentrated product; much less energy is required to dilute the concentrated product than to upgrade the dilute product. Still another factor which may cause high cell voltages is the possibility of an outworn anode However, much of the time, when the cell voltage becomes high, the problem is a deposition of calcium in the membrane, and in accordance with the present invention, the problem should be dealt with as indicated above.

It is, of course, a matter for the judgement of the operator of the process to determine how much to permit the cell voltage to rise before taking corrective action. In a commercial context, it will usually be desirable to take such action whenever the voltage increase has amounted, to over thirty days or so of operation, to 100 millivolts, but in some circumstances greater increases in voltage will be considered tolerable, in the cell-voltage-lowering action will be taken correspondingly less frequently. Conversely, voltage-lowering action may be necessary in some circumstances considerably earlier than it would otherwise be undertaken; for example, if the cell is inadvertently fed a brine which contains 10 or 40 parts per million of calcium, it will be desirable, as soon as this is discovered and a supply of proper brine can be assured, to take the indicated corrective action.

With the present invention, it thus becomes possible to contemplate the operation of a membrane cell for: the electrolysis of sodium chloride brine, with the cell operating substantially continuously for extended periods of time, such as 10 to 24 months, without need for disassembly of the equipment to remove calcium from the membrane. In most circumstances, the service life of the cell is determined not by this consideration but rather by either the service life of the heat treatment on the membrane or the wear properties of the material used to construct the cell.

The invention described above is further illustrated by the following specific examples.

EXAMPLE 1

A laboratory-scale chlor-alkali membrane cell having a membrane area of 18 square inches (116 square centimeters) had been operated for 170 days at 25 amperes current and with a brine containing between one and five parts per million of calcium and between one and three parts per million of magnesium. The cell had dimensionally stable anodes, and it had a membrane made of a copolymer of tetrafluoroethylene and perfluorovinylether sulfonyl fluoride and having an equivalent weight of 1350, such as material commercially available as "NAFION" resin. the cell potential, initially 3.6 volts, had risen to 4.09 volts. The catholyte compartment was normally fed with demineralized water at a rate of 75 milliliters per hour. The current to the cell was completely interrupted for a period of 2 minutes, and during that time, the water feed rate was increased to 500 milliliters per minute. Samples of the catholyte effluent were taken before, during, and after the flushing, and they were analyzed for calcium, magnesium, and total organic carbon. After the flushing, the cell potential stabilized at 3.73 volts. The data concerning the catholyte effluent are presented below in Table I.

TABLE I

| | Ca | Mg (ppm) | TOC |
|---|---|---|---|
| Feed Water | 1.3 | 0.4 | 0 |
| Catholyte before flush | 6.2 | 4.0 | 9 |
| Catholyte during flush | 11.3 | 2.2 | 18 |
| Catholyte 1 hour after flush | 76 | 16.3 | 43 |
| Catholyte 4 hours after flush | 6.8 | 1.3 | 11 |

EXAMPLE 2

Example 1 was repeated, using a membrane of somewhat different specifications —to be precise, the difference was that the resin of the membrane had an equivalent weight of 1200 instead of 1350. Initially, the cell voltage was 3.10 volts, but after several weeks, the potential had risen to 3.74 volts. To lower the cell voltage, the current was interrupted for one minute and the catholyte feed rate was increased from a normal 95 milliliters per hour to 600 milliliters per hour for a 1 minute period. Within hours, the cell voltage fell to 3.12 volts.

EXAMPLE 3

After being operated for 161 days, a membrane cell was at a cell voltage of 3.95 volts, as compared with an initial value of 3.41 volts. A voltage-lowering action was taken: the current was lowered to 5 percent of the normal value and the water feed to the catholyte was increased tenfold, for a period of 90 minutes. When normal operation was resumed, the cell voltage was 3.61 volts.

EXAMPLE 4

A membrane cell had an initial potential of 3.44 volts, and after several weeks of operation, the potential had risen to 3.86 volts. As a voltage-lowering action, the current was completely interrupted for 35 minutes but the catholyte was not flushed. When normal operation was resumed, the cell voltage was 3.75 volts.

EXAMPLE 5

Example 4 was repeated, except that the current was interrupted for only 15 minutes. The cell voltage was initially 3.51, had reached 4.04 at the time action to lower it was taken, and was 3.72 after the voltage-lowering treatment.

While certain embodiments of the present invention have been shown and described herein, it is intended that there be covered as well any change or modification therein which may be made without departing from the spirit and scope of the invention.

The embodiments of the invention in which an exclusive property or privilege is claimed are defined as follows:

1. A process for electrolyzing sodium chloride brine in an electrolytic cell having a dimensionally stable anode, a cathode, and between said anode and said cathode a membrane of copolymerized tetrafluoroethylene and perfluorovinylether sulfonylfluoride having an equivalent weight number of approximately 1000 to 1500 and a thickness of approximately 0.1 to 0.5 millimeters, said process involving the electrolysis of brine containing a membrane obstructing proportion of calcium not exceeding 6 parts per million of calcium, said process including the use at intervals of approximately once per month or less frequently of a voltage-reduction action, said voltage-reduction action comprising reducing the current through said electrolytic cell for a period of 0.5 to 90 minutes to a value of less than 20 percent of the current normally used.

2. A process as defined in claim 1, wherein said voltage-reducing step comprises reducing the flow of current through said cell to a value of less than 5 percent of the value normally used for a period of 1 to 20 minutes.

3. A process as defined in claim 2, characterized in that said voltage-reducing step further comprises the practice of increasing the flow of liquid, during said time of current reduction, through the portion of said cell between said membrane and said cathode to a value of five to twenty times the flow during normal operation by addition of water to said portion.

4. A process as defined in claim 1, characterized in that said voltage-reducing step further comprises the practice of increasing the flow of liquid, during said time of current reduction, through the portion of said cell between said membrane and said cathode to a value of 5 to 20 times the flow during normal operation by addition of water to said portion.

5. A process for electrolyzing sodium chloride brine in an electrolytic cell having a dimensionally stable anode, a cathode, and between said anode and said cathode a membrane of copolymerized tetrafluoroethylene and perfluorovinylether sulfonylfluoride having an equivalent weight number of approximately 1000 to 1500 and a thickness of approximately 0.1 to 0.5 millimeters, said process involving the electrolysis of brine containing a membrane obstructing proportion of calcium not exceeding 6 parts per million of calcium, said process including the use at intervals of approximately once per month or less frequently of a voltage-reduction action, said voltage-reduction action comprising interrupting the flow of current through said electrolytic cell for a period of 0.5 to 90 minutes.

6. A process as defined in claim 5, wherein said voltage-reducing step comprises interrupting the flow of the current through said cell for a period of 1 to 20 minutes.

7. A process as defined in claim 6, characterized in that said voltage-reducing step further comprises the practice of increasing the flow of liquid, during said time of current interruption, through the portion of said cell between said membrane and said cathode to a value of 5 to 20 times the flow during normal operation by addition of water to said portion.

8. A process as defined in claim 5, characterized in that said voltage-reducing step further comprises the practice of increasing the flow of liquid during said time of current interruption, through the portion of said cell between said membrane and said cathode to a value of 5 to 20 times the flow during normal operation by addition of water to said portion.

* * * * *